US008546751B2

(12) United States Patent
Franzen

(10) Patent No.: US 8,546,751 B2
(45) Date of Patent: Oct. 1, 2013

(54) 3D ION TRAP AS FRAGMENTATION CELL

(75) Inventor: Jochen Franzen, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 498 days.

(21) Appl. No.: 12/430,511

(22) Filed: Apr. 27, 2009

(65) Prior Publication Data

US 2009/0283675 A1 Nov. 19, 2009

(30) Foreign Application Priority Data

May 15, 2008 (DE) ..... 10 2008 023 693

(51) Int. Cl.
*H01J 49/04* (2006.01)

(52) U.S. Cl.
USPC ..... 250/288; 250/282; 250/281; 250/283; 250/286; 250/287

(58) Field of Classification Search
None
See application file for complete search history.

(56) References Cited

U.S. PATENT DOCUMENTS

| | | | | |
|---|---|---|---|---|
| 6,833,544 | B1 * | 12/2004 | Campbell et al. | 250/282 |
| 6,924,478 | B1 * | 8/2005 | Zubarev et al. | 250/282 |
| 6,998,610 | B2 * | 2/2006 | Wang | 250/290 |
| 7,019,289 | B2 * | 3/2006 | Wang | 250/290 |
| 7,309,860 | B2 * | 12/2007 | Baba et al. | 250/288 |
| 7,329,866 | B2 * | 2/2008 | Wang | 250/290 |
| 7,372,042 | B2 * | 5/2008 | Mordehai et al. | 250/396 R |
| 7,446,312 | B2 * | 11/2008 | Rather | 250/288 |
| 7,449,687 | B2 * | 11/2008 | Li | 250/293 |
| 7,456,397 | B2 * | 11/2008 | Hartmer et al. | 250/292 |
| 7,476,853 | B2 * | 1/2009 | Zubarev et al. | 250/292 |
| 7,534,622 | B2 | 5/2009 | Hunt et al. | |
| 7,582,862 | B2 * | 9/2009 | Hartmer | 250/282 |
| 7,582,864 | B2 * | 9/2009 | Verentchikov | 250/290 |
| 7,589,320 | B2 * | 9/2009 | Baba et al. | 250/290 |
| 7,642,509 | B2 * | 1/2010 | Hartmer et al. | 250/282 |
| 7,728,288 | B2 * | 6/2010 | Makarov et al. | 250/282 |
| 2004/0149903 | A1 * | 8/2004 | Wang | 250/292 |
| 2005/0145790 | A1 * | 7/2005 | Wang | 250/292 |
| 2005/0199804 | A1 * | 9/2005 | Hunt et al. | 250/290 |
| 2005/0279932 | A1 * | 12/2005 | Wang | 250/290 |
| 2006/0169892 | A1 * | 8/2006 | Baba et al. | 250/292 |
| 2006/0186331 | A1 * | 8/2006 | Hartmer et al. | 250/288 |
| 2006/0192100 | A1 * | 8/2006 | Zubarev et al. | 250/282 |
| 2006/0289741 | A1 * | 12/2006 | Li | 250/288 |
| 2007/0045531 | A1 * | 3/2007 | Mordehai et al. | 250/285 |
| 2007/0051886 | A1 * | 3/2007 | Rather | 250/288 |
| 2007/0057172 | A1 | 3/2007 | Wang | |
| 2007/0084998 | A1 * | 4/2007 | Franzen et al. | 250/287 |

(Continued)

FOREIGN PATENT DOCUMENTS

| | | |
|---|---|---|
| EP | 1 598 850 A2 | 11/2005 |
| GB | 2 454 762 A | 5/2009 |

(Continued)

*Primary Examiner* — Andrew Smyth
(74) *Attorney, Agent, or Firm* — Robic, LLP

(57) ABSTRACT

In a tandem mass spectrometer with mass selector spatially separated from a mass analyzer, ions are fragmented in a three-dimensional RF by electron transfer dissociation. The fragment ions are then extracted from the 3D ion trap and introduced into the mass analyzer. The extraction is accomplished by providing, in one of the ion trap end cap electrodes, an aperture with a relatively large area covered by a conductive mesh or formed by closely spaced smaller apertures. The fragment ions are extracted from the RF ion trap by applying a DC voltage to one of the end cap electrodes.

9 Claims, 3 Drawing Sheets

(56) References Cited

U.S. PATENT DOCUMENTS

| | | | | |
|---|---|---|---|---|
| 2007/0158545 | A1* | 7/2007 | Verentchikov | 250/282 |
| 2008/0044915 | A1 | 2/2008 | Hunt et al. | |
| 2008/0048110 | A1 | 2/2008 | Deguchi et al. | |
| 2008/0078930 | A1* | 4/2008 | Baba et al. | 250/288 |
| 2008/0093546 | A1* | 4/2008 | Hartmer | 250/282 |
| 2008/0093547 | A1* | 4/2008 | Hartmer et al. | 250/283 |
| 2008/0191129 | A1* | 8/2008 | Makarov et al. | 250/282 |
| 2009/0032698 | A1* | 2/2009 | Furuhashi et al. | 250/282 |
| 2009/0242748 | A1* | 10/2009 | Li | 250/282 |
| 2010/0072360 | A1* | 3/2010 | Green et al. | 250/282 |

FOREIGN PATENT DOCUMENTS

| | | | |
|---|---|---|---|
| GB | 2 455 386 | A | 6/2009 |
| WO | WO 02/101787 | | 12/2002 |
| WO | WO 2009/037598 | A2 | 3/2009 |

* cited by examiner

3D ION TRAP AS FRAGMENTATION CELL

BACKGROUND

The invention relates to tandem mass spectrometers with a spatially separated mass selector and mass analyzer, with a cell for fragmentation by electron transfer dissociation (ETD). Investigation of the structures and functional activities of proteins, and also of other biopolymers, is largely based on so-called tandem mass spectrometry, which not only provides spectra of the protein ion mixtures but also allows individual protein ions to be selected as "parent ions" for fragmentation, isolated from other ions and then fragmented so that the fragment ions produced can be measured in a mass spectrum. Depending on the type of fragmentation, these fragment ion mass spectra especially provide information on the primary and secondary structures of the proteins that allows not only the genetically determined basic structure of their amino acids (the "sequence") to be identified according to type and localization, but also other modifications that are important because they change the function of the protein ("posttranslational modifications", PTM).

The individual steps of tandem mass spectrometry are first selection and isolation of the parent ions, then fragmentation, and finally mass analysis of the fragment ions. In storage mass spectrometers such as ion traps, these steps can be carried out consecutively in the same storage unit ("tandem-in-time"). But the selection and isolation of the analyte ions to be fragmented can also be carried out in a first mass analyzer, the "mass selector", with fragmentation in a special cell which may or may not be identical with the mass selector, and with mass analysis in a second spatially separated mass analyzer ("tandem-in-space"). The invention relates to such a tandem mass spectrometer with spatially separated mass selector and mass analyzer.

The use of tandem mass spectrometry in temporal sequence in storage mass spectrometers is extraordinarily widespread and has been shown to be very useful up to a certain point. This applies both to tandem mass spectrometry in ion cyclotron resonance mass spectrometers (ICR-MS), where ultra-high mass resolutions can be achieved, and also to the use of RF ion trap mass spectrometers (IT-MS) with limited mass resolution and mass accuracy. Both types of tandem mass spectrometer have limitations, however, which concern partly the measuring speed (ICR-MS is slow), partly the mass range (IT-MS has a lower mass cut-off) and partly the mass accuracy (IT-MS has limited accuracy), and are largely determined by the type of fragmentation used. Nowadays, tandem mass spectrometry is often coupled with relatively fast separation methods for the substances, for example nano-liquid chromatography (nano-HPLC) or capillary electrophoresis (CE), so the substances of the short substance peaks can only be analyzed for a few seconds at most in the mass spectrometer. Measuring speed thus plays an important role; moreover, it is becoming increasingly important to achieve, in particular, high mass accuracy and to acquire a fragment ion spectrum that is as complete as possible, including the light fragment ions.

Because of the high demands placed on mass accuracy and speed in the measurement of fragment ions, it has proved advantageous to carry out the fragmentation in a separate cell and to then measure the fragment ions produced in an especially suitable mass analyzer, particularly a time-of-flight mass spectrometer with orthogonal injection of the ions (OTOF-MS). Modern Kingdon ion traps or ion cyclotron resonance mass spectrometers can also be used as mass analyzers owing to their high mass resolution, but only if the measuring speed is of secondary importance.

The success of tandem mass spectrometry depends on the fragmentation methods used. There are essentially only two fundamentally different types of fragmentation available for proteins or similar biopolymers: "ergodic" and "electron-induced" fragmentation. For each of these there are many different favorable embodiments. The various individual methods often have deficiencies with respect to the mass range of the fragment ion spectra, the fragmentation speed and, in particular, the quality of the fragment ion spectra, and therefore how well they can be evaluated. The quality of the fragment ion spectra may be defined by a high yield of terminal fragment ions, producing ladders covering as equally as possible all amino acids, low chemical background noise, and low amounts of internal fragments which greatly disturb the evaluation.

These fragmentation methods will therefore be discussed here before the invention can be explained. The reaction cells for the fragmentation always have the form and function of RF ion traps; the fragmentation of the selected parent ions takes place inside these reaction cells.

As has been noted above, two fundamentally different kinds of fragmentation are now available in reaction cells of various kinds: "ergodic" fragmentation and "electron-induced" fragmentation. These lead to two significantly different kinds of fragment ion spectra, whose information content is complementary and which produce particularly detailed information on the structures of the analyte ions when both types of fragment ion spectra are measured.

The term "ergodic" fragmentation of analyte ions (sometimes also called "thermal") here means a fragmentation where a sufficiently large excess of internal energy in the analyte ions leads to fragmentation decay via a "metastable state" with a decomposition half-life of between several and several hundred microseconds (or more). The excess energy can, for example, be produced by a large number of inelastic collisions of the analyte ions with a collision gas; or by the absorption of many photons from an infrared radiation source.

The conventional type of fragmentation of the analyte ions in RF ion traps is ergodic fragmentation by collisions of the somehow accelerated analyte ions with the collision gas contained in the ion trap. In this process, the excess internal energy of the moving analyte ions is collected by collisions with the stationary collision gas molecules. In order for the collisions to be able to pump any energy into the analyte ion at all, they have to occur with a minimum of collision energy. Since gentle collisions of the analyte ions with the collision gas can always cause an internal cooling by removing energy, there is always competition between "heating" and "cooling"; physically heavy ions, in particular, require a higher collision energy for the heating than light ions. At a specified density of the collision gas and specified kinetic energy of the collisions, for physically heavy analyte ions above a certain mass it is always the cooling which predominates; these analyte ions cannot be fragmented at all in this way.

In three-dimensional RF ion traps ("3D ion traps") consisting of a ring electrode and two end cap electrodes, the collision energy is generated in a conventional way by limited resonant excitation of the secular ion oscillations of the parent ions with a dipolar alternating voltage on the end cap electrodes. This leads to many collisions with the collision gas without removing the ions from the ion trap. The parent ions can accumulate energy in the collisions, which finally leads to ergodic decomposition of the parent ions and the creation of fragment ions. The fragment ions are often also called "daughter ions". Until a few years ago, this collision-induced dissociation (CID) was the only known type of fragmentation in ion traps.

This collision-induced dissociation in three-dimensional RF ion traps also has disadvantages, however. For physically heavy analyte ions, it is necessary to set the RF voltage for storing the ions at a very high level in order to produce sufficiently hard collision conditions. This results in a very high minimum mass threshold for the ion trap. Ions with masses below this mass threshold can no longer be stored; they are lost. The fragment ion spectrum therefore only starts at a mass which, according to a conventional rule of thumb, is about one third of the charge-related mass m/z of the analyte ion; the fragment ion spectrum can no longer provide any information on the light fragment ions because these ions are lost. Multiply charged, physically heavy analyte ions with physical masses of many thousand daltons regularly have a relatively low charge-related mass m/z of about 700 to 1200 daltons, owing to the large number of protons; these analyte ions cannot be fragmented at all because the RF voltage cannot be set high enough to produce sufficient numbers of high-energy collisions.

There thus remains the big disadvantage of conventional collision-induced dissociation that with physically heavy analyte molecules above about m=3000 daltons, the corresponding analyte ions can hardly be fragmented at all with the conventional collision method.

An ergodic fragmentation which does not have this disadvantage has been described in the document WO 02/101 787 A1 (S. A. Hofstadler, and J. J. Drader). This method applies infrared multi-photon dissociation (IRMPD), which is known from ICR mass spectrometry, to RF ion traps as well. The infrared radiation here is introduced into a three-dimensional RF ion trap via an evacuated hollow fiber with an optically reflective internal coating, through the ring electrode which is perforated for this purpose. This type of fragmentation is advantageous because it can be carried out at low RF voltages; the small fragment ions are then also stored. The internal surfaces of the ion trap must be kept extremely clean because any molecules adhering to the walls are detached by the irradiation of the infrared photons and then react with the stored analyte ions in a variety of ways. This is the main reason why there are still no commercially available ion trap mass spectrometers with this type of fragmentation.

Another ergodic fragmentation method in ion traps has recently been proposed which also does not have the disadvantage of being unable to fragment heavy analyte ions or store light fragment ions. In this case, stationary stored analyte ions are bombarded with preferably anti-polar, if possible mono-atomic, collision ions with adjustable kinetic energy. Since the RF voltage here can be set very low, heavy analyte ions can be successfully fragmented due to the higher energy transfer per collision, and on the other hand, very light fragment ions can be trapped and measured.

This means there is now at least one method of ergodic fragmentation available which no longer has any significant disadvantages.

Now we turn to the electron-induced fragmentation methods. About ten years ago, a completely new type of fragmentation of protein ions was discovered: a non-ergodic fragmentation induced by the capture of low-energy electrons (ECD="electron capture dissociation"). By the direct neutralization of an associated proton at one position in the amino acid chain, which then gets lost as a radical hydrogen atom, the potential equilibrium of the protein ion in the vicinity of the neutralized proton is disturbed so much that a cleavage of the amino acid chain is induced by corresponding rearrangements. The cleavage does not affect a peptide bond, but predominantly an adjacent bond, leading to so-called c and z fragment ions. In contrast with ergodic fragmentation, this fragmentation occurs spontaneously, in less than $10^{-8}$ seconds.

This type of fragmentation is particularly easily to carry out in ICR mass spectrometers because the low-energy electrons from a thermionic cathode can easily be supplied along the lines of magnetic force to the stored cloud of analyte ions. But ECD fragmentation can only be used with some difficulty in RF ion traps because the strong RF fields do not easily allow the low-energy electrons to come very close to the cloud of analyte ions. Nevertheless, there are a number of solutions for ECD fragmentation in RF ion traps, but they each require costly apparatus and have not yet achieved a satisfactory sensitivity.

A few years ago, a method for the fragmentation of ions in RF ion traps was presented which produces fragmentations similar to electron capture dissociation (ECD) but by different reactions: "electron transfer dissociation" (ETD). ETD can easily be carried out in ion traps by adding suitable negative ions to the stored analyte ions. Methods of this type have been described in U.S. Pat. No. 7,456,397 B2 (R. Hartmer and A. Brekenfeld) and US 2005/0199804 A1 (D. F. Hunt et al.). As in ECD, the fragment ions here belong to the so-called c and z series, and are therefore very different to the fragment ions of the b and y series obtained by ergodic fragmentation. In particular, all the side chains, which are always lost with ergodic fragmentation, are preserved during electron transfer dissociation, including the important posttranslational modifications such as phosphorylations, sulfurylations and glycosylations.

The fragmentation of protein ions by electron transfer (ETD) in an RF ion trap is brought about in a very simple way by reactions between multiply charged positive protein ions and suitable negative ions. Suitable negative ions are usually aromatic radical anions, such as those of fluoranthene, fluorenone, anthracene or other polyaromatic compounds; but there are also some non-aromatic radical ions, like e.g. those of cyclooctatetradiene, which can be used successfully for ETD. In radical anions, the chemical valences are not saturated, so they can easily donate electrons and thus achieve an energetically favorable non-radical form. They are generated in NCI ion sources (NCI="negative chemical ionization"), most probably by electron capture or by electron transfer. NCI ion sources are constructed, in principle, like ion sources for chemical ionization (CI ion sources), but operated differently in order to obtain large quantities of low-energy electrons. NCI ion sources are also called electron attachment ion sources.

Ergodic fragmentation initially cleaves all posttranslational modifications that are only weakly bonded, such as phosphorylations, sulfurylations and glycosylations, and essentially displays the naked sequences of the unmodified amino acids of the analyte ions. Therefore, neither the existence, nor the type or position of the posttranslational modifications can be identified. In contrast with ergodic fragmentation, these modifications are not cleaved off by electron-induced fragmentation. In comparison with the ergodically obtained fragment ion spectra, an additional mass at an amino acid thus shows both the type and also the position of the modification. These extraordinarily important investigative results can only be obtained in this favorable and simple way by comparing both types of fragment ion spectra.

Particularly for investigating posttranslational modifications (PTM), it is therefore necessary nowadays to acquire ion spectra both by ergodic fragmentation and by electron-induced dissociation in parallel. Both types of fragment ion spectra should also satisfy the highest quality requirements. A modern tandem mass spectrometer for bio-analyses must therefore offer both types of fragmentation in methods that are as free from deficiencies as possible. But also for other analyses, such as de novo sequencing, a comparison of good quality fragment ion spectra obtained using both ergodic and electron-induced methods is advantageous or even absolutely imperative.

Until now, only 2D ion traps have been used as separate ETD fragmentation cells in tandem mass spectrometers with high-resolution mass analyzers. Although ETD fragmentation can also be performed in 3D ion traps, the commercial instruments so used are limited to those mass spectrometers which simultaneously use this 3D ion trap as the sole mass analyzer for measuring the fragment ion spectra. Their design does not allow the fragment ions to be transferred into a different mass analyzer.

The ETD fragment ion spectra from 2D ion traps are not of a very high quality; they are enriched with high proportions of unused analyte ions and fragment ions of the second and third generation (with many so-called "internal fragment ions", which are not terminal) and are also not very sensitive.

Three-dimensional ion traps have occasionally been coupled to mass analyzers with a higher mass resolution, but they have never been used for an ETD fragmentation. Such use of a 3D ion trap for an (albeit only ergodic) fragmentation relates to a commercially available Shimadzu tandem mass spectrometer, in which the 3D ion trap is used to axially inject the ions from its interior into a time-of-flight mass spectrometer by means of a high-voltage pulse. Ergodic fragmentation is possible in this 3D ion trap; a version with electron-induced fragmentation is neither known nor available. This mass spectrometer requires separate filling of the 3D ion trap for each time-of-flight mass spectrum. It is a relatively slow and insensitive instrument because, in each individual time-of-flight mass spectrum, the dynamic range of measurement is limited by the small conversion width of current transient recorders, and the 3D ion trap can therefore only be operated with a limited number of analyte ions.

SUMMARY

The invention provides a 3D RF ion trap for ETD fragmentation of parent ions instead of the 2D RF ion traps that have so far been used exclusively in tandem-in-space mass spectrometers. The 3D RF ion trap is specially designed and equipped to enable an extraction of the ions after fragmentation, and to transfer the resulting fragment ions from the 3D ion trap to a suitable mass analyzer for precise and fast mass analysis. Surprisingly, much better fragment ion spectra can be obtained in terms of their evaluation quality, at least for fragmentation by electron transfer dissociation (ETD), as found by our own investigations using 3D ion trap mass spectrometers, on the one hand, and 2D ion traps as fragmentation cells, on the other. There are no disadvantages for ergodic fragmentation methods. It has also been found that the ETD fragmentation spectra from 3D ion traps are far superior to those from the 2D ion traps used so far in regard to the achievable sensitivity of the tandem mass spectrometer. Hypotheses to explain the higher quality and significantly better sensitivity are presented below.

Because the 3D RF ion trap itself is not used as a mass analyzer, the filling quantity can be increased to between 20,000 and 100,000 analyte ions, instead of being limited in ion trap mass spectrometers to between about 10,000 and 20,000 analyte ions due to the requirements of the mass determination. Once the fragment ions have been transferred to the mass analyzer, fragment ion spectra with a good dynamic range of measurement can be achieved there with a single filling of the 3D ion trap.

Both the shape and the electronic equipment of the 3D ion trap must be specially adapted so that the now enlarged cloud of fragment ions can be extracted from it with only minimum losses. It is advisable to build the 3D ion trap with high precision and to replicate 3D ion traps used for mass analysis, in order that the instrument can be employed as a mass selector for isolating the analyte ions, for example, and thus retain the control methods with today's very highly developed electronics and software.

BRIEF DESCRIPTION OF THE DRAWINGS

In FIG. 1, the quantity of analyte ions (curve 30) in a 3D ion trap used as a fragmentation cell decreases very rapidly during a constant supply of radical anions for the electron transfer dissociation and formation of the desired fragment ions of the first generation (curve 31), because the radical anions introduced can reach and react with every analyte ion stored with approximately the same probability. The formation of undesirable fragment ions of the second generation (curve 32) or third generation (curve 33) progresses only very slowly. There is a point (line 35) at which an optimum quantity of fragment ions of the first generation are present in the 3D ion trap, with only a small residual quantity of unfragmented analyte ions, and only a small quantity of undesirable fragment ions of the second generation. At this point (line 35), the supply of negative radical ions, and thus further fragmentation, should be stopped; the mixture of ions now results in a fragment ion spectrum that can be evaluated very well.

FIG. 2, on the other hand, shows how the breakdown of analyte ions (curve 40) is slower in a 2D ion trap, while the undesirable formation of fragment ions of the second (curve 42) and third generation (curve 43) progresses faster because the clouds of analyte ions and radical anions only mix by gradual penetration of individual sections, while further mixing causes the fragment ions to be further deprotonated by fresh radical anions, thus forming fragment ions of the second and higher generation. There is no really favorable point in time at which qualitatively good fragment ion spectra are acquired without large amounts of unused analyte ions and fragment ions of the second or third generation.

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

Until now, because a lack of intensive investigation it is only possible to hypothetically surmise why the ETD fragmentation of parent ions in 3D ion traps produces fragment ion spectra that are much more sensitive and can be so much better evaluated. The hypothesis is based on the following model:

2D RF ion traps (also called "linear ion traps") as fragmentation cells for parent ions are predominantly designed as quadrupole or hexapole rod systems. In 2D ion traps, the parent ions that have been freshly introduced or isolated in the cell are stored in the form of a string-like cloud of small diameter in the longitudinal axis of the rod system after their oscillations have been damped by the collision gas. For fragmentation by electron transfer, parent ions are selected that are at least doubly, preferably triply, quadruply, quintuply, or even more highly charged; in borderline cases, parent ions with 10 or even 15 charges can be fragmented. At both ends of the rod systems, the parent ions are held in the rod system by opposing DC fields on apertured diaphragms. Once the elongated parent ion cloud has formed, the negative radical anions are axially introduced into this rod system at low kinetic energy. They initially meet the parent ions in the cloud head facing them, where they react by fragmenting the parent ions into daughter ions ("fragment ions of the first generation"). The radical anions are consumed in the reaction, and only the addition of further radical anions can reach the parent ions in the cloud behind the cloud head and react with them by fragmentation.

Figure 2:
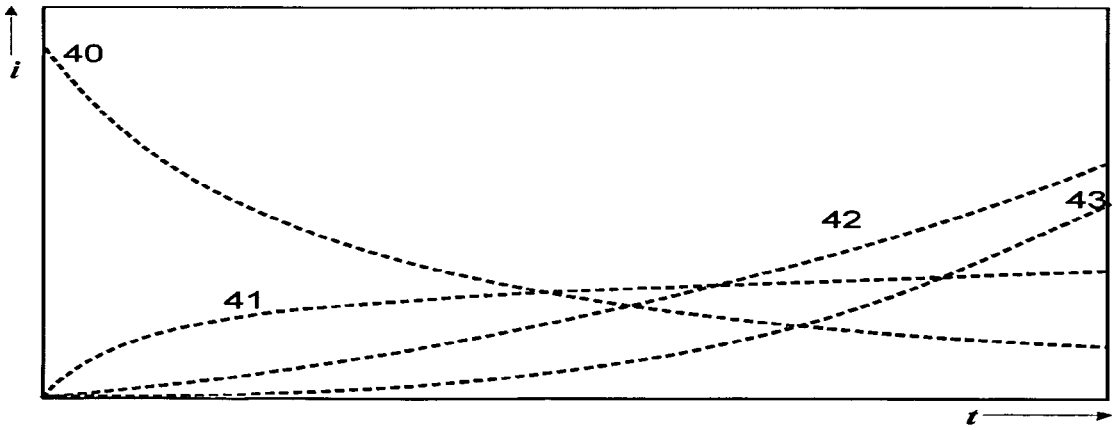

But these newly introduced radical anions can also react with the fragment ions of the cloud head which have already formed, further fragmenting them to a second and even third generation of fragment ions ("granddaughter ions" and "great-granddaughter ions"), or even destroying them by complete deprotonation by the electrons, which are easily transferred by the radical anions. This continued fragmentation of fragment ions frequently leads to "internal fragment ions" that are not terminal, and are thus more difficult to interpret; ultimately it leads to the complete destruction of a portion of the fragment ions already formed. This continued fragmentation has smaller reaction cross-sections, and hence does not lead to the complete destruction of all the fragment ions of the first generation (the "daughter ions") that have just been formed. However, it does mean that (a) only a small proportion of the analyte ions in the string-like long cloud are permanently transformed to useful fragment ions of the first generation, and that (b) the fragment ion spectrum contains a large quantity of undesirable fragment ions of the second or third generation, which makes it much more difficult to evaluate it qualitatively. FIG. 2 illustrates in principle how the formation of the various desired (curve 41) and undesirable fragment ions (curves 42, 43) is assumed to progress as the parent ions (curve 40) are used up. At no time is there a mixture of ions which would produce a fragment ion spectrum that can be evaluated well.

There are also rod systems split into sections whose axis potentials can be adjusted sectionwise to different levels. In such systems the parent ions can be stored in only one of the sections, while the negative radical anions introduced can then be collected in a different section. By removing the potential differences in the axis potential, the elongated clouds of parent ions and radical anions can be brought together. The same effect now occurs here: first, the two cloud heads mix, causing reactions and fragmentation. Then the fragment ions formed are exposed to a further supply of radical anions and can fragment in the second generation and, finally, even be completely discharged. Only a small proportion of the parent ions remain converted to fragment ions of the first generation. The method thus uses only a small proportion of the parent ions and is very insensitive; the fragment ion spectrum cannot be evaluated very well because of the high proportion of fragment ions of the second and higher generations.

Figure 1:
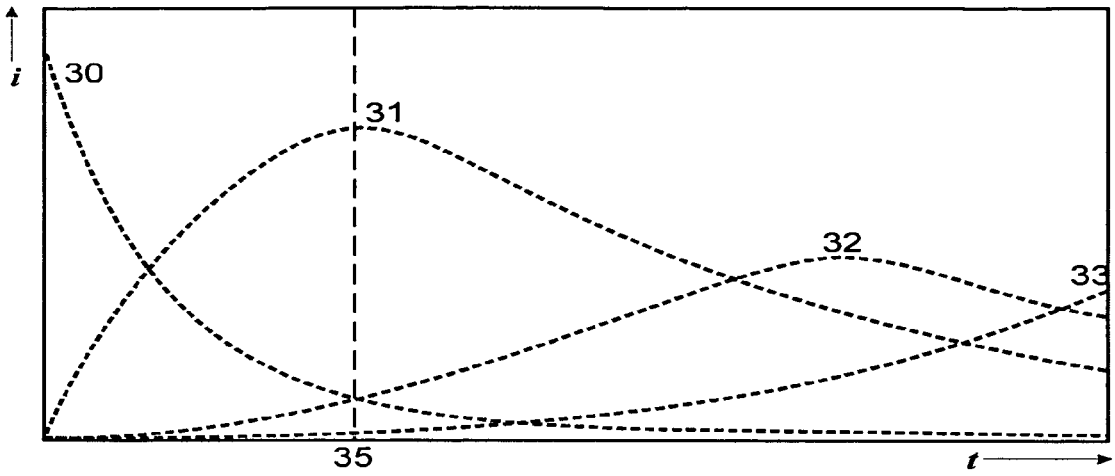
FIGS. 1 and 2 are two hypothetical time diagrams which show how, according to current assumptions, the temporally advancing formation of fragment ions of different generations (daughters, granddaughters, great-granddaughters) from the stored analyte ions proceeds by electron transfer dissociation in a 3D ion trap (FIG. 1) and a 2D ion trap (FIG. 2).

In 3D RF ion traps, on the other hand, the parent ions collect in a small spherical cloud in the center of the ion trap. As subsequently introduced radical anions are being captured in the ion trap, they perform damped oscillations in more or less all directions through the interior of the ion trap. These oscillations carry the radical anions through the cloud of parent ions again and again. They can react with any of the parent ions with about the same probability. FIG. 1 shows how the formation of fragment ions of the desired first generation (curve 41) proceeds quickly at the expense of the parent ions (curve 30) before undesirable fragment ions of the second (curve 32) and third generation (curve 33) start to be formed. If this process is stopped at a favorable time (line 35), the ion trap will contain a large quantity of first-generation fragment ions (curve 31), but not too many unfragmented parent ions (curve 30), and only an insignificant quantity of second-generation fragment ions (curve 32). The fragment ion spectrum is of excellent quality.

If one compares the sensitivities based on the percentage utilization of the available parent ions, the 3D ion trap offers a sensitivity for the mass spectrometer that is higher by about a factor of ten under otherwise identical operating conditions.

Figure 3:
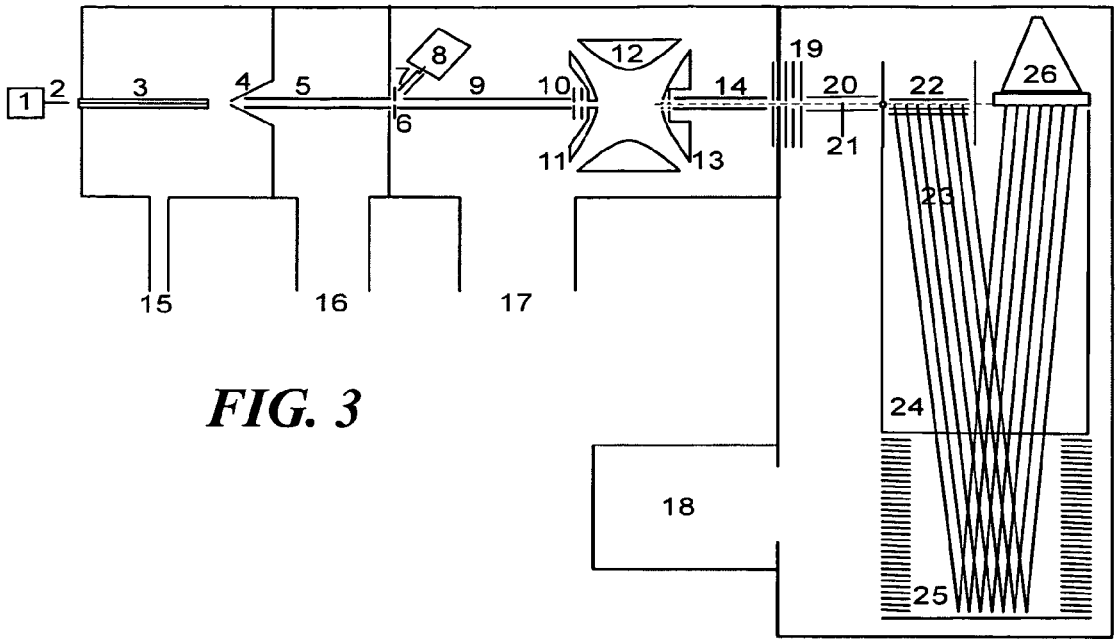
FIG. 3 shows an embodiment of a tandem mass spectrometer according to this invention, where both the selection of the parent ions for the fragmentation and also the fragmentation itself can take place in a 3D ion trap with ring electrode (12) and two end cap electrodes (11,13). The fragment ions are removed from the 3D ion trap, and introduced via the ion guide (14) into a time-of-flight mass spectrometer (24) with orthogonal injection (OTOF) for measurement with high mass accuracy. The analyte ions here are generated in an electrospray ion source (1, 2) outside the vacuum system of the tandem mass spectrometer, and the radical anions are generated in an NCI ion source (8) within the vacuum system.

A favorable embodiment of a tandem mass spectrometer according to this invention is schematically shown in FIG. 3. The embodiment is explained here by describing how an analytical method for the generation of a fragment ion spectrum is carried out. It will be assumed that a mixture of digest peptides of a large protein is to be analyzed, and that a fragment ion spectrum of one of the digest peptides is to be measured.

The tandem mass spectrometer comprises an electrospray ionization source (1) with a spray capillary (2) outside the mass spectrometer for the ionization of biomolecules at atmospheric pressure. The electrospray ionization source produces virtually no fragment ions; the mass spectrum shows almost only singly and predominantly multiply protonated molecules which are often called "pseudomolecular ions" because the additional protons make them heavier than the original molecules. The mixture of analyte ions produced is fed in the usual way through an inlet capillary (3) and a skimmer (4) into the ion guides (5) and (9) which guide the ions through the pressure stages (15), (16), (17) to the 3D ion trap with end cap electrodes (11 and 13) and ring electrode (12), where they are captured in the usual way. The ion guides (5) and (9) consist of parallel rod pairs across which the two phases of an RF voltage are alternately applied. They can take the form of a quadrupole, hexapole or octopole rod system.

The capture of the ions is still considered to be the weak point of 3D ion traps because only between about five and, at most, about ten percent of the ions supplied are captured, according to results of approximating simulations. This may, however, be open to question in view of the fact that the 3D ion trap mass spectrometers are among the most sensitive mass spectrometers on the market. It seems that the utilization of the supplied ions by the capture process of a 3D ion trap is significantly better than its theoretically derived reputation.

The 3D ion trap in the tandem mass spectrometer of FIG. 3 serves both to select the parent ions from the mixture of analyte ions by the process known as "isolation", and also to fragment them using the various fragmentation methods. The fragmentation by transfer of the electrons from radical anions shall be in the foreground of the description here. The 3D ion trap here is not used to mass-analyze the analyte or fragment ions, which are instead removed from the 3D ion trap in a special way and guided to a separate mass analyzer.

In this embodiment, a time-of-flight mass spectrometer (24) with orthogonal ion injection is used as the mass analyzer. The ions extracted from the 3D ion trap are injected at low energy via the channel (20) along the trajectory (21) into the pulser (22). In the pulser (22), a section of the string-shaped ion beam is very quickly accelerated perpendicular to its previous trajectory, and the ions now fly as string-shaped sections of the original ion beam at mass-specific speed along the trajectory (23) and into the reflector (25), where they are reflected and directed onto the ion detector (26), highly resolved according to mass. In special commercial embodiments, this type of time-of-flight mass spectrometer presently provides a mass resolution $R=m/\Delta m$ of between 20,000 and 60,000, a very good mass accuracy of about one millionth of the mass (1 ppm), and a very large spectral range for the charge-related masses m/z between about 50 daltons and 5,000 daltons. The pulser rate is about 5 to 10 kilohertz, which allows 5,000 to 10,000 mass spectra per second to be acquired and added together; correspondingly fewer in a shorter period. This mass spectrometer can be adjusted to suit many requirements such as fast measurements with 20 spectra per second and more, on the one hand, or measurements with a high dynamic range by adding up 50,000 spectra on the other.

A first mass spectrum of the unfragmented analyte ions (a mixture of peptides digested from a protein) provides an overview of the digest peptides. If it is now intended to analyze the amino acid sequence of one or more peptides, the triply, quadruply or quintuply charged ions of this peptide are isolated by normal methods after renewed filling of the 3D ion trap; this means that the ion trap is first overfilled and then all ions that do not correspond to the selected parent ions of this peptide are ejected from the ion trap. This isolation of the selected parent ions is carried out by mass-selectively ejecting all undesirable ions from the 3D ion trap by resonance or other processes. These processes are well-known from 3D ion trap mass spectrometers. The number of charges is identified by the spacing of the isotope lines; for triply charged ions, for example, this is exactly ⅓ of an atomic mass unit.

The multiply charged parent ions for the fragmentation, which have been excited to slight oscillations by the isolation processes, are decelerated back into the center of the trap by the collision gas by a short delay of a few milliseconds. In 3D ion traps, helium at a pressure of about $10^{-2}$ pascal is usually used as the collision gas; in special cases, the pressure used can be up to two orders of magnitude higher. The multiply charged parent ions form a small spherical cloud, whose diameter depends on the number of stored ions, and also on the value of the RF voltage. It can easily be about two to three millimeters if the RF voltage is low and if there are a large number of between 20,000 and 50,000 selected parent ions.

The negatively charged radical anions are then added. These ions are generated in a separate ion source (8) for negative chemical ionization and fed via a small ion guide (7) to an ion merger, where they are introduced via the ion guide (9) into the ion trap (11, 12, 13). In the embodiment shown here, the ion merger simply comprises an apertured diaphragm (6) and a shortening of two of the rods in the ion guide (9). It is particularly advantageous for this very simple type of ion merger if an octopole rod system is used as the ion guide. This ion merger can allow the analyte ions of the electrospray ion source (1, 2) to pass unhindered when there is a suitable voltage at the diaphragm (6); with other voltages the negative radical anions from the ion source (8) are reflected into the ion guide (9). The negative radical anions reach the 3D ion trap via this ion guide (9) and are stored in the usual way by an injection lens (10). Here, they react immediately (within a few milliseconds) with the positive parent ions, usually by spontaneous decomposition. As described above, all parent ions experience a decay with about the same probability.

Instead of prompt decay after the transfer of an electron, some stable radical cations may be formed if the neutralized proton remains attached. When these radical cations do not immediately decompose, a weak dipolar excitation alternating voltage for a resonant excitation of the radical cations can be applied across both end caps (11, 13) of the ion trap to support the decomposition. The frequency for this alternating excitation voltage can be calculated from the known mass of these radical cations and their known charge. This excitation voltage brings about an increase in the yield of the desired fragment ion species.

There are various well-known methods of determining the times for optimum filling of the ion trap, but they will not be discussed further here. The filling times aim at a filling with an optimum number of parent ions after the isolation, essentially the number of charges inside the ion trap. The number of charges after isolation should amount to a fixed number in the range of 20,000 to 100,000 charges. Since the optimum filling time depends on the concentration of the parent ions within the mixture, it must be controlled for each filling by one of the known methods. For the filling with negative ions, on the other hand, it is only necessary to determine the best possible filling time once, since roughly the same number of negative ions are always used for the best possible reaction with the fixed number of positive parent ions.

The form of the 3D ion trap and its power supply must be adapted to the task of extracting the fragment ions from the 3D ion trap without any losses, as far as possible, in order to then feed them to the mass analyzer. If the 3D ion trap also has to perform the task of selecting and isolating the parent ions, it is advantageous to retain the functions of those 3D ion traps which also serve as mass analyzers. These 3D ion traps are manufactured with the utmost precision, with hyperbolic interior surfaces of the ring and end cap electrodes. Slight deliberate deviations from the theoretically correct shape may lead to so-called nonlinear resonances, which can intensify electrically induced resonance excitations of the ions and make them effective in a shorter time. Modern 3D ion traps use these nonlinear resonances both for the mass-selective ejection of the ions for mass measurement, and also for the isolation process. It is therefore advantageous to also retain these slight intentional deviations in the shape. The 3D ion traps of this type are often simply called "nonlinear ion traps" because the electric RF field (and thus also the pseudopotential) increases nonlinearly from the center of the ion trap to the electrodes.

Interestingly, all commercially manufactured 3D ion traps have a separation of 14 millimeters between the two apexes of the end cap electrodes inside the ion trap mass spectrometer. This dimension came about as a multiple compromise between mechanical and electric parameters, particularly for the operating range of the RF voltages, and should therefore also be retained where possible. This size goes right back to Wolfgang Paul, the inventor of the ion trap (for which he won the Nobel Prize in 1989).

As already noted above, the diameter of the spherical cloud of parent ions increases for operation as a fragmentation cell because, for one, more parent ions can and should be introduced, and also because, for the permanent storage of the light fragment ions of interest, the RF voltage at the ring electrode is kept relatively low in order to lower the mass threshold below which no ions can be stored. This causes the pseudopotential well to flatten for all ions, depending on their mass, and the cloud increases in size. The size of the cloud is regulated by the equilibrium between centrifugal Coulomb repulsion and centripetal focusing by the pseudopotential. The cloud of fragment ions does have about the same size as that of the parent ions. If this large cloud of fragment ions is to be ejected from the 3D ion trap, the corresponding aperture in the exit end cap must be enlarged. For commercial 3D ion trap mass spectrometers, this aperture is between about 0.7 and, at most, 1.5 millimeters. Since the cloud can be up to three millimeters in size, however, this aperture must also be increased to around three millimeters (or more), but at least to 2.5 millimeters.

Figure 5:
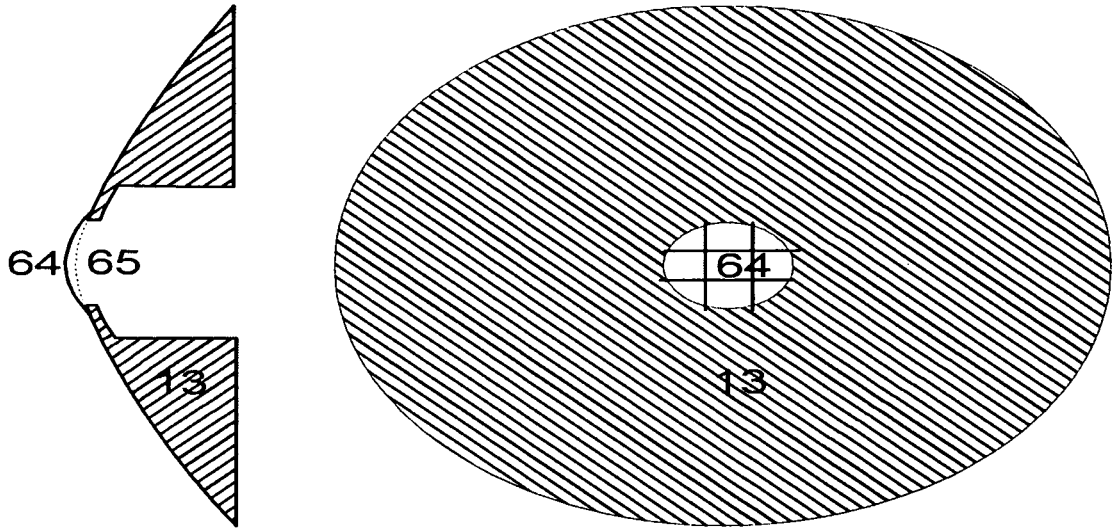
FIG. 5 represents the end cap electrode (13) with a large exit aperture spanned by wires (64). The wires form a coarse wire mesh which is more bowed here than would correspond to the contour (65) of the hyperbolic end cap electrode.

Such an enlargement of the exit aperture greatly changes the RF field in the interior and must be compensated by special measures, particularly for nonlinear ion traps. In principle, the compensation can be effected by changing the shape of the electrodes, especially in the vicinity of the exit aperture, but this is difficult and involves a large development effort. It is easier to approximately retain the electrical effect of the shape of the end cap electrodes by closing the aperture with a medium-mesh grid of very thin wires, for example. This grid should follow the desired surface like a cap. FIG. 5 shows such a covering of a large aperture with a coarse grid of fine wires.

There are many known methods for the precise fastening and tensioning of the fine wires. For example, "bonding" of fine gold wires, 25 to 50 micrometers in diameter, a technique used in several forms in integrated circuit technology, is also suitable here. The aperture to be covered can initially be closed with a shaped part which exactly follows the cap shape of the grid. Other ways of fastening and tensioning thin wires are also known, including some which make use of cold welding.

It is advantageous to use a quite coarse-meshed grid, as in FIG. 5, so that the thin wires only cover a small part of the surface. It is thus possible to produce nine openings, each with a mesh of around one millimeter, using only two crosswise wires in each direction. With four wires in each of the two directions, a mesh of half a millimeter can be obtained, resulting in a better reshaping of the electric RF fields in the interior of the 3D ion trap, but also slightly higher ion losses.

Figure 4:
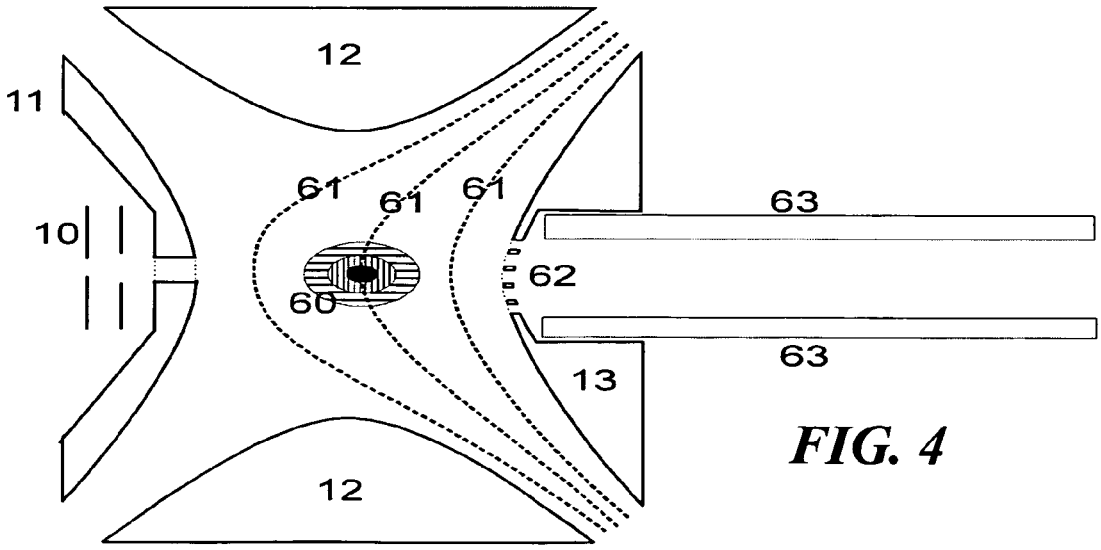
FIG. 4 shows a 3D ion trap with injection diaphragms (10), first end cap electrode (11), ring electrode (12) and ejection end cap electrode (13). An ion cloud (60, disproportionately large in the diagram) formed like an onion skin is shown before extraction by a DC field with equipotential surfaces (61). The DC field, which has just been switched on, will draw the ions toward the array (62) of exit apertures. The array of exit apertures is also disproportionately large in the diagram. The emerging ions are accepted by the next ion storage device, here an octopole rod system, from where they can be fed to the mass analyzer.
Figure 6:
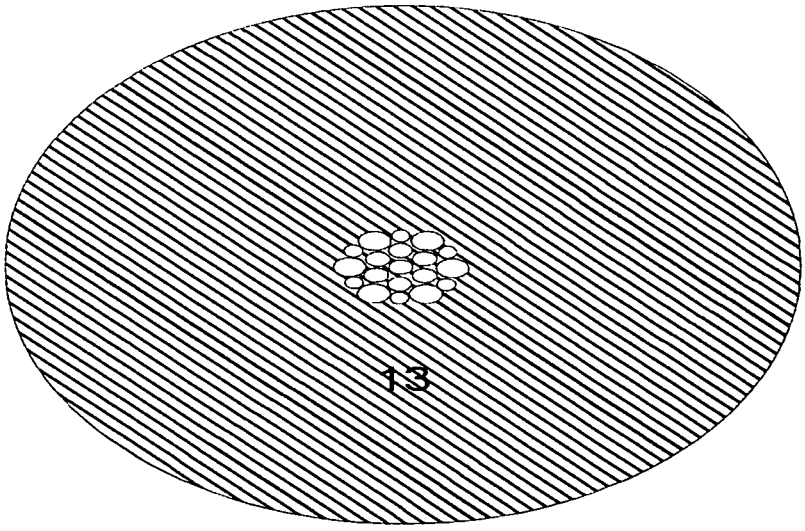
FIG. 6 shows an end cap electrode (13) with a ring of exit apertures of different sizes, which have only very little material remaining between them.

The larger aperture can also be produced by a finely drilled pattern of holes, as indicated in FIGS. 4 and 6. A central aperture between half and one millimeter in diameter can thus be surrounded by one or two rings of apertures, for example, as can be seen in FIG. 6. The diameters of the apertures are chosen so that as little material as technically possible remains between the holes.

Both the wires spanning the large aperture and also the material around an array of holes arranged in a circle can trace a contour of the surface which is more strongly curved and bulging than corresponds to the rotational hyperbolic shape of the end cap electrodes. This partly compensates the influence of the holes on the RF field in the interior.

Particularly important is the electronic equipment of the 3D ion trap. It is advantageous to extract the fragment ions while maintaining a weak pseudopotential well in order to keep the cloud of ions as close together as possible until the end. If the RF voltage is set so the mass threshold for the lightest ions is around 60 daltons, there will be an RF field with peak voltages of about 300 volts between the center of the ion trap and the exit apertures in the end cap electrode.

The depth of the pseudopotential well and the steepness of its wall, which is (fictitiously) experienced by an ion, depends on the mass of the ion. The pseudopotential can be calculated as the time integral over the accelerations which the RF field exerts on the ions. For light ions, the accelerations are high and the pseudopotential well is very deep due to the large accelerations; they therefore collect in the center of the ion cloud. The heavier ions then arrange themselves like onion skins around this center, as is indicated in FIG. 4; the heaviest ions are on the outside, in the equilibrium between the repulsion by the charges of the ions (Coulomb forces) in the ion cloud and the centripetal force of the pseudopotential, which is only weak for these heavy ions.

If one applies a DC extraction voltage to the end cap electrode which contains the exit aperture, an extraction field with equipotential surfaces (61) is produced in the interior of the ion trap, as shown in FIG. 4, and this field draws the ions to the exit aperture (62) and focuses them. An extraction field of limited strength initially extracts the heavy, only weakly trapped ions of the outer onion skin of the ion cloud (60); they are kept fairly close together by the potential well of the pseudopotential and move to the exit aperture (62) in the rhythm of the RF voltage and can emerge in a favorable phase of the RF voltage, even if the DC extraction voltage is significantly smaller than the above-stated RF peak voltage.

Because the temporal sequence and duration of the ions' extraction are unimportant, the lighter ions can now be extracted by increasing the DC extraction voltage or by decreasing the RF voltage. The speed of these voltage changes is hardly important; the extraction can quite easily take between 100 microseconds and one millisecond (or more). The extracted ions are then introduced into the next ion storage device (63) in form of a 2D ion trap. An octopole rod system is advantageous here because it also accepts ions which enter relatively far away from the axis. The axis DC potential in this ion trap is set so that the ions extracted only enter with a very low kinetic energy in order not to allow further fragmentations by collisions with the damping gas, which is also present here. From this ion storage device (63) the ions are then guided to the mass analyzer.

The fragmentation cell in the tandem mass spectrometer according to the invention can, however, be used not only for fragmentation by electron transfer dissociation (ETD) but also for ergodic fragmentations. For example, by installing a further suitable ion source for the generation of negative iodine ions in the instrument shown in FIG. 3, it is possible to induce an ergodic fragmentation of positively charged protein parent ions by ion bombardment. If these iodine ions are introduced into the 3D ion trap with a suitably selected RF voltage, the stationary stored parent ions are subjected to collisions in such a way that they absorb large amounts of energy with every collision and are thus quite quickly undergo ergodic fragmentation. A high-quality fragment ion spectrum with a large mass range can thus be acquired. The fragmentation of protein ions with a physical mass above 3000 or so daltons is also possible.

This tandem mass spectrometer according to this invention thus offers both types of fragmentation, each to a high level of quality, ideal for the analysis of posttranslational modifications and many other structural details.

What is claimed is:

1. A tandem-in-space mass spectrometer with a mass selector for selecting parent ions and a mass analyzer spatially separated from the mass selector, the spectrometer comprising:

a 3D RF ion trap formed from a ring electrode and two end cap electrodes connected to sources of RF potential that is constructed to provide fragment ions to the mass analyzer; and a control system configured to control the 3D RF ion trap to dissociate the selected parent ions by electron transfer reactions and to then extract the parent ions and resulting fragment ions from the 3D RF ion trap and transfer them to the mass analyzer, wherein the 3D RF ion trap is not used as a mass analyzer.

2. The tandem mass spectrometer of claim 1, wherein the 3D RF ion trap is a nonlinear 3D ion trap.

3. The tandem mass spectrometer of claim 1, wherein the control system comprises a power supply connected to the 3D RF ion trap and a control unit that controls the power supply so that the 3D RF ion trap acts as the mass selector to select and isolate parent ions.

4. The tandem mass spectrometer of claim 1, wherein one of the end cap electrodes comprises at least one exit aperture with a diameter of at least 2.5 millimeters for extracting ions from the 3D RF ion trap.

5. The tandem mass spectrometer of claim 4, wherein the at least one exit aperture is covered by a conductive mesh.

6. The tandem mass spectrometer of claim 4, wherein the at least one end cap electrode comprises a plurality of adjacent exit apertures wherein the diameters of the plurality of exit apertures total to at least 2.5 millimeters.

7. The tandem mass spectrometer of claim 4, further comprising an ion storage device located between the at least one exit aperture and the mass analyzer into which the extracted ions enter.

8. The tandem mass spectrometer of claim 1, further comprising a DC voltage supply connected to at least one of the end cap electrodes that supplies a DC voltage to extract ions from the 3D RF ion trap.

9. A method of operating a tandem-in-space mass spectrometer having a 3D RF ion trap as fragmentation cell, which is not used to mass-analyze parent ions or fragment ions, comprising:

(a) constructing the 3D ion trap with a ring electrode and two end cap electrodes connected to sources of RF potential in such a manner that the trap can provide fragment ions to a mass analyzer;

(b) providing selected positively-charged parent ions to the 3D RF ion trap, and operating the 3D RF ion trap by a control system to dissociate the selected positively-charged parent ions by electron transfer reactions;

(c) constantly supplying negative radical ions for electron transfer dissociation and formation of first generation fragment ions to the 3D RF ion trap;

(d) stopping the supply of negative radical ions to the 3D RF ion trap when a predetermined quantity of first generation fragment ions is present in the 3D RF ion trap;

(e) conveying the first generation fragment ions, together with the other ions present in the 3D RF ion trap, from the 3D RF ion trap to the mass analyzer which is spatially separated from the 3D RF ion trap; and (f) mass analyzing the first generation fragment ions with the mass analyzer.

* * * * *